US008132880B2

(12) United States Patent
Tanaka et al.

(10) Patent No.: US 8,132,880 B2
(45) Date of Patent: Mar. 13, 2012

(54) LIQUID EJECTING DEVICE AND METHOD OF CONTROLLING LIQUID EJECTING DEVICE

(75) Inventors: Ryoichi Tanaka, Shiojiri (JP); Kazuhito Hori, Azumino (JP); Hirokazu Nunokawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 667 days.

(21) Appl. No.: 12/265,570

(22) Filed: Nov. 5, 2008

(65) Prior Publication Data

US 2009/0115807 A1 May 7, 2009

(30) Foreign Application Priority Data

Nov. 6, 2007 (JP) ..... 2007-288159

(51) Int. Cl.
*B41J 29/38* (2006.01)

(52) U.S. Cl. ..... 347/14; 347/19

(58) Field of Classification Search ..... 347/13, 347/14, 19
See application file for complete search history.

(56) References Cited

U.S. PATENT DOCUMENTS

| | | | | |
|---|---|---|---|---|
| 6,964,465 | B2 * | 11/2005 | Endo | 347/19 |
| 7,484,827 | B2 | 2/2009 | Morikawa et al. | |
| 7,703,871 | B2 * | 4/2010 | Tanaka | 347/13 |
| 7,726,765 | B2 * | 6/2010 | Yoshida et al. | 347/19 |
| 2004/0150730 | A1 | 8/2004 | Satake et al. | |
| 2005/0007404 | A1 * | 1/2005 | Usui | 347/14 |
| 2007/0091130 | A1 * | 4/2007 | Endo | 347/9 |
| 2011/0084996 | A1 * | 4/2011 | Hirato et al. | 347/10 |

FOREIGN PATENT DOCUMENTS

| | | |
|---|---|---|
| JP | 03-182453 | 8/1991 |
| JP | 06-183029 | 7/1994 |
| JP | 2005-022134 | 1/2005 |
| JP | 2005-313625 | 11/2005 |
| JP | 2006-181728 | 7/2006 |
| JP | 2007-001183 | 1/2007 |
| JP | 2007-163737 | 6/2007 |

* cited by examiner

*Primary Examiner* — Charlie Peng
(74) *Attorney, Agent, or Firm* — Workman Nydegger

(57) ABSTRACT

A liquid ejecting device includes a nozzle group formed by aligning nozzles that eject a liquid, and a liquid ejecting head that ejects liquids from the nozzles based on ejection serial data that represents ejection or non-ejection of each nozzle of the nozzle group. The liquid ejecting head ejects a liquid to a landing target while the liquid ejecting head and the landing target are relatively moved in a second direction that is perpendicular to a first direction in which the nozzles are aligned. The liquid ejecting device further includes a meandering correction pattern forming unit that forms a meandering correction pattern along the second direction in a margin outside the regulated landing area of the landing target and a meandering correction pattern detecting unit that detects the meandering correction pattern formed in the landing target by the meandering correction pattern forming unit.

6 Claims, 12 Drawing Sheets

LIQUID EJECTING DEVICE AND METHOD OF CONTROLLING LIQUID EJECTING DEVICE

BACKGROUND

1. Technical Field

The present invention relates to a liquid ejecting device and a method of controlling a liquid ejecting device, and more particularly, to a liquid ejecting device having the configuration in which a liquid is ejected in a state that a long liquid ejecting head, in which a nozzle group is disposed in a length corresponding to a maximum width of a landing target at a predetermined pitch, is disposed to be fixed in a position with respect to a device main body or a liquid is ejected by moving a liquid ejecting head in the print direction without transporting the landing target and a method of controlling the liquid ejecting device.

2. Related Art

Liquid ejecting devices are devices that have a liquid ejecting head for ejecting a liquid and eject various types of liquids from the liquid ejecting head. As a major liquid ejecting device, for example, there is an image recording device such as an ink jet printer that performs a record operation by ejecting (emitting) and landing ink having a liquid phase to a landing target such as a recording sheet. In addition, recently, the liquid ejecting device is not limited to the image recording device and is applied to various types of manufacturing apparatuses. For example, in an apparatus for manufacturing a display such as a liquid crystal display, a plasma display, an organic EL (Electro Luminescence) display, or an FED (Field Emission Display) the liquid ejecting device is used for ejecting various types of materials such as a coloring material or an electrode having a liquid phase to a pixel forming area, an electrode forming area, or the like.

An ink jet recording device (so called a printer) that is one type of the liquid ejecting devices has an ink jet recording head (one type of a liquid ejecting head, so called a serial head) that is shorter than the width of a recording medium, a head moving mechanism that reciprocates the record head in the main scanning direction, a transport mechanism (recording medium transporting mechanism) that performs a sub scanning operation by sending the recording medium (landing target) such as a recording sheet in the direction perpendicular to the main scanning direction, and the like. The ink jet recording device is configured to record an image or the like in the recording medium by alternately repeating ejection of ink droplets in the main scanning of the record head and transporting (sub scanning) of the recording medium. However, since there is a limit in the scanning speed of the record head, there is a problem for a device of this type that a long time period is needed, for example, in a case where an image is recorded on the entire surface of the recording medium that has relatively large size.

Thus, recently, a device that is configured to eject ink in a state that a long record head (one of line-type liquid ejecting heads, hereinafter referred to as a line-type head) in which a nozzle group is disposed in a length corresponding to a maximum width of a recording medium at a predetermined pitch is fixed without being moved with respect to a device main body has been proposed (JP-A-6-183029 (FIGS. 2 to 4)). According to such a configuration, movement of the record head in the main scanning direction is not needed, and recording an image or the like can be performed only by transporting the recording medium in the sub scanning direction. As a result, according to the configuration, a record time can be shortened, compared to a configuration using a serial head.

In addition, a printer in which a plurality of heads ejecting ink droplets of a same color is disposed in parallel, a plurality of ejection stages (record stages) is disposed along the direction perpendicular to the direction of the parallel disposition, and an image or the like is sequentially recorded in the recording medium by using record heads, which are disposed for each ejection stage, in each ejection stage while relatively moving the record head and the landing target in the perpendicular direction has been proposed.

For example, as shown in FIG. 12, there is a configuration in which line-type record heads 51*a* to 51*d* corresponding to colors of black (K), cyan (C), magenta (M) and yellow (Y) are disposed in ejection stages 52*a* to 52*d* along the transport path of a recording sheet 54 and an image or the like is formed in the recording sheet 54 for each color while the recording sheet 54 is transferred among transport belts 53*a* to 53*d* of the ejection stages. In the transport belt in each ejection stage, a linear scale 55 and a linear encoder 56 having a sensor unit that optically detects the scale pattern of the linear scale 55 are disposed, and a record operation is controlled based on a detection signal output from the linear encoder 56.

Under such a configuration, there is a case where the transport speed of the recoding sheet 54 changes due to a mechanical error of a transport unit including the transport belt or the like. In addition, in transferring the recording sheet 54 among the transport units of the ejection stages, the position of the recording sheet 54 in the direction (direction of alignment of the nozzles) perpendicular to the transport direction may be deviated. The transport error may cause the deviation of ink landing positions in the recording sheet 54 among the ejection stages. As a result, there is a possibility that the image quality of the image recorded in the recording sheet 54 deteriorates. In addition, when a print operation is performed by moving the line-type record heads 51*a* to 51*d* in the print direction without transporting the recording sheet 54 in the transport direction, if the recording sheet 54 is deviated in the print direction, the landing position of ink in the recording sheet 54 may be deviated. As a result, there is a possibility that the image quality of the image recorded in the recording sheet 54 deteriorates, as in the above-described case in which the recording sheet 54 is transported.

FIGS. 13A to 13D are diagrams represented by enlarging a part of an image P of the recording sheet 54 in a third ejection stage 52*c* in the above-described configuration. When the positional deviation of the recording sheet 54 in the transport direction among the ejection stages or the positional deviation of the recoding sheet in the direction perpendicular to the transport direction is not generated at all, as shown in FIG. 13A, in this example, a pixel Px1 (for example, a pixel of cyan) formed in a second ejection stage 52*b* and a pixel Px2 (for example, a pixel of magenta) formed by the third ejection stage 52*c* are orderly disposed in a zigzag pattern vertically and horizontally. However, when any countermeasure is not taken under the configuration, there is a rare case that the deviation of landing positions in both vertical and horizontal directions is not generated at all.

For example, when the positional deviation of the recording sheet 54 in the transport direction is generated between the second ejection stage 52*b* and the third ejection stage 52*c*, as shown in FIG. 13B, a deviation of the landing positions of the pixel Px1 and the pixel Px2 is generated. In addition, when the positional deviation of the recording sheet 54 in the direction of alignment of nozzles is generated between the second ejection stage 52*b* and the third ejection stage 52*c*, that is, when a state in which the recording sheet 54 meanders is formed, as shown in FIG. 13C, a deviation of landing positions in the direction of alignment of nozzles is generated between the pixel Px1 and the pixel Px2. Practically, as shown in FIG. 13D, the positional deviation is frequently generated in both directions of the transport direction and the direction of alignment of nozzles. When the deviation of the landing positions is generated, other pixels are overlapped with each other, and accordingly, the color may change. In addition, by forming a gap between the pixels, there is a possibility that the image becomes rough.

SUMMARY

An advantage of some aspects of the invention is that it provides a liquid ejecting device, which is configured to eject a liquid by using a liquid ejecting head disposed to be in correspondence with a maximum width of a landing target, capable of suppressing the deviation of liquid landing positions at a time when an image or the like is recorded in the landing target.

According to a first aspect of the invention, there is provided a liquid ejecting device including: a nozzle group formed by aligning a plurality of nozzles that eject a liquid; and a liquid ejecting head that ejects liquids from the plurality of nozzles based on ejection serial data that is information representing ejection or non-ejection of each nozzle of the nozzle group. The liquid ejecting head ejects a liquid to a landing target while the liquid ejecting head and the landing target are relatively moved in a second direction that is perpendicular to a first direction in which the plurality of nozzles is aligned, and the nozzle group includes a preliminary nozzle corresponding to an area outside a regulated landing area of the landing target. In addition, the liquid ejecting device further includes: a meandering correction pattern forming unit that forms a meandering correction pattern along the second direction in a margin outside the regulated landing area of the landing target; a meandering correction pattern detecting unit that detects the meandering correction pattern formed in the landing target by the meandering correction pattern forming unit; and a data correction unit that corrects the ejection serial data in accordance with a deviation of the meandering correction pattern detected by the meandering pattern detecting unit. The data correction unit adds dummy data, which represents non-ejection, corresponding to the amount of the deviation to the front side of the ejection serial data in a case where the meandering correction pattern detected by the meandering correction pattern detecting unit is deviated from the original position to one side of the first direction and removes data, which is located on the front side of the ejection serial data, corresponding to the amount of the deviation in a case where the detected meandering correction pattern is deviated from the original position to the other side of the first direction.

Here, the "regulated landing area" means an area, in which a liquid lands for forming an image or the like, of a landing target that is located in a regulated position in which the landing target is originally supposed to be located.

According to the aspect above, the meandering correction pattern is formed in the margin of the landing target along the second direction, and dummy data, which represents non-ejection, corresponding to the amount of the deviation is added to the front of the ejection serial data in a case where the meandering correction pattern is deviated from the original position to one side of the first direction, and data, which is located on the front side of the ejection serial data, corresponding to the amount of the deviation is removed in a case where the detected meandering correction pattern is deviated from the original position to the other side of the first direction. Thus, correspondence between each nozzle of the nozzle group and the ejection serial data changes in accordance with the positional deviation of the landing target in the direction of alignment of the nozzles. Accordingly, the deviation of the liquid ink landing positions in the first direction for the landing target can be suppressed by performing a simple control operation of addition or removal of data without performing complex control such as re-expanding the ejection serial data.

In the above-described liquid ejecting device, it is preferable to employ a configuration in which a plurality of ejection stages is disposed along the second direction, the liquid ejecting head is disposed in each of the plurality of ejection stages, the meandering correction pattern forming unit forms the meandering correction pattern in the landing target in a first ejection stage that is located in the front side of the second direction by using the liquid ejecting head disposed in the first ejection stage, the meandering correction pattern detecting unit is disposed in each of the plurality of ejection stages that is located after the first ejection stage, and the data correction unit corrects the ejection serial data for each of the plurality of ejection stages that is located after the first ejection stage.

In the above-described liquid ejecting device, it is preferable that the liquid ejecting device further includes: an encoder pulse outputting unit that outputs an encoder pulse in accordance with driving a movement unit that moves the landing target or the liquid ejecting head in the second direction in the first ejection stage; a timing correction pattern forming unit that forms a timing correction pattern in the margin of the landing target along the second direction in the first ejection stage; a timing correction pattern detecting unit that is disposed in each of the plurality of ejection stages that is located after the first ejection stage and detects the timing correction pattern formed in the landing target by the timing correction pattern forming unit; and a timing pulse generating unit that generates a timing pulse based on a detection pulse that is output in accordance with the encoder pulse output from the encoder pulse outputting unit or detection of the timing correction pattern by the timing correction pattern detecting unit. In such a case, it is preferable that the timing pulse generating unit generates the timing pulse based on the encoder pulse in the first ejection stage and generates the timing pulse based on the detection pulse in the plurality of ejection stages that are located after the first ejection stage and the liquid ejecting head ejects a liquid at a timing regulated in accordance with the timing pulse.

In such a case, the timing correction pattern is formed in the margin of the landing target along the second direction in the first ejection stage, and the timing correction pattern formed in the landing target is detected in each ejection stage that is located after the first ejection stage. In addition, the timing pulse is generated based on the encoder pulse in the first ejection stage, and the timing pulse is generated based on the detection pulse that is output by detecting the timing correction pattern in each ejection stage that is located after the first ejection stage. In addition, each liquid ejecting head ejects a liquid at a timing regulated in accordance with the timing pulse. As a result, the ejection timing of the liquid ejecting head can be controlled in accordance with the positional deviation of the landing target in the second direction. Therefore, the deviation of liquid landing positions in the landing target can be suppressed in the second direction.

According to a second aspect of the invention, there is provided a method of controlling a liquid ejecting device including: a nozzle group formed by aligning a plurality of nozzles that eject a liquid; and a liquid ejecting head that ejects liquids from the plurality of nozzles based on ejection serial data that is information representing ejection or non-ejection of each nozzle of the nozzle group. The liquid ejecting device ejects a liquid from the liquid ejecting head to a landing target while the liquid ejecting head and the landing target are relatively moved in a second direction that is perpendicular to a first direction in which the plurality of nozzles is aligned. The method includes: disposing a preliminary nozzle corresponding to an area outside a regulated landing area of the landing target in the nozzle group; forming a meandering correction pattern along the second direction in a margin outside the regulated landing area of the landing target; detecting the meandering correction pattern formed in the landing target; and adding dummy data, which represents non-ejection, corresponding to the amount of the deviation to the front side of the ejection serial data in a case where the detected meandering correction pattern is deviated from the original position to one side of the first direction and removing data, which is located on the front side of the ejection serial data, corresponding to the amount of the deviation in a case where the detected meandering correction pattern is deviated from the original position to the other side of the first direction.

According to the aspect above, the meandering correction pattern is formed in the margin of the landing target along the second direction, and dummy data, which represents non-ejection, corresponding to the amount of the deviation is added to the front of the ejection serial data in a case where the meandering correction pattern is deviated from the original position to one side of the first direction, and data, which is located on the front side of the ejection serial data, corresponding to the amount of the deviation is removed in a case where the detected meandering correction pattern is deviated from the original position to the other side of the first direction. Thus, correspondence between each nozzle of the nozzle group and the ejection serial data changes in accordance with the positional deviation of the landing target in the first direction. Accordingly, the deviation of the liquid ink landing positions in the first direction for the landing target can be suppressed by performing a simple control operation of addition or removal of data without performing complex control such as re-expanding the ejection serial data.

It is preferable the above-described method further includes: forming the meandering correction pattern in the landing target in a first ejection stage that is located in the front side of the second direction by using the liquid ejecting head disposed in a first ejection stage; detecting the meandering correction pattern in each of plurality of ejection stages located after the first ejection stage; and correcting the ejection serial data based on the meandering correction pattern, wherein the plurality of ejection stages is disposed along the second direction.

In addition, it is preferable the above-described method further includes: forming a timing correction pattern in the margin of the landing target along the second direction in the first ejection stage; detecting the timing correction pattern formed in the landing target in each of the plurality of ejection stages that is located after the first ejection stage; generating the timing pulse based on an encoder pulse that is output in synchronization with driving a movement unit, which moves the landing target or the liquid ejecting head in the second direction in the first ejection stage, in the first ejection stage and generating the timing pulse based on a detection pulse that is output in accordance with detection of the timing correction pattern in the plurality of ejection stages that are located after the first ejection stage; and controlling liquid ejection of the liquid ejecting head at a timing regulated in accordance with the timing pulse.

In such a case, the timing correction pattern is formed in the margin of the landing target along the second direction in the first ejection stage, and the timing correction pattern formed in the landing target is detected in each ejection stage that is located after the first ejection stage. In addition, the timing pulse is generated based on the encoder pulse in the first ejection stage, and the timing pulse is generated based on the detection pulse that is output by detecting the timing correction pattern in each ejection stage that is located after the first ejection stage. In addition, liquid ejection by using each liquid ejecting head is controlled at a timing regulated in accordance with the timing pulse. As a result, the ejection timing of the liquid ejecting head can be controlled in accordance with the positional deviation of the landing target in the second direction. Therefore, the deviation of liquid landing positions in the landing target can be suppressed in the second direction.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a preferred embodiment for performing the present invention will be described with reference to the accompanying drawings. In the embodiment to be described below is an appropriate example of the invention, and various limitations such as a configuration in which a recording sheet is transported and a line-type head that becomes a head unit group is not moved in the transport direction are applied. However, the scope of the invention is not limited thereto unless otherwise described in descriptions below. In addition, as an example of a liquid ejecting device according to an embodiment of the invention, an ink jet printer (hereinafter, abbreviated as a printer) shown in FIGS. 1A and 1B will be exemplified.

Figure 1A:
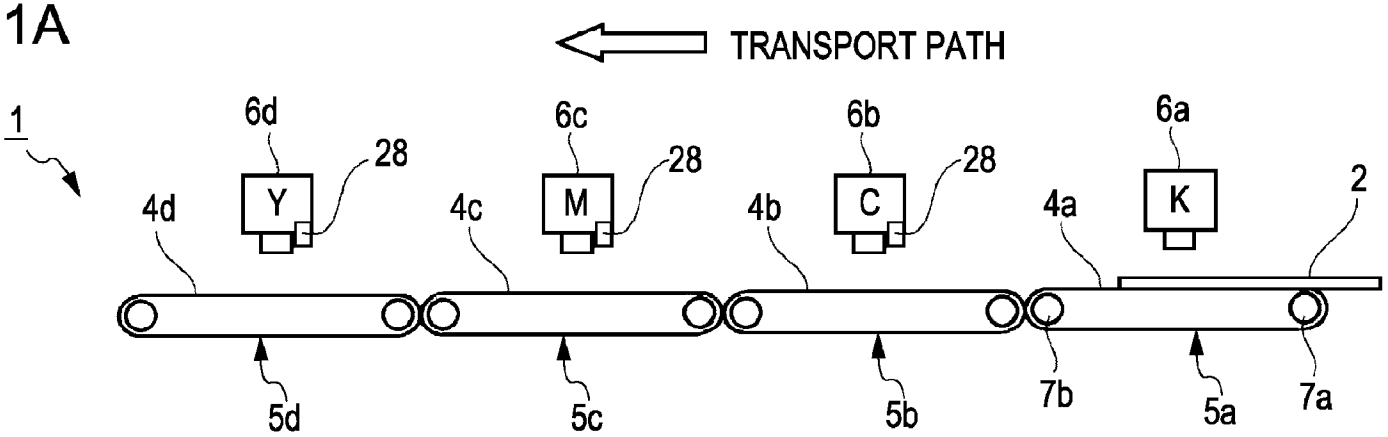
FIGS. 1A and 1B are diagrams showing the configuration of a printer according to an embodiment of the invention.
Figure 1B:
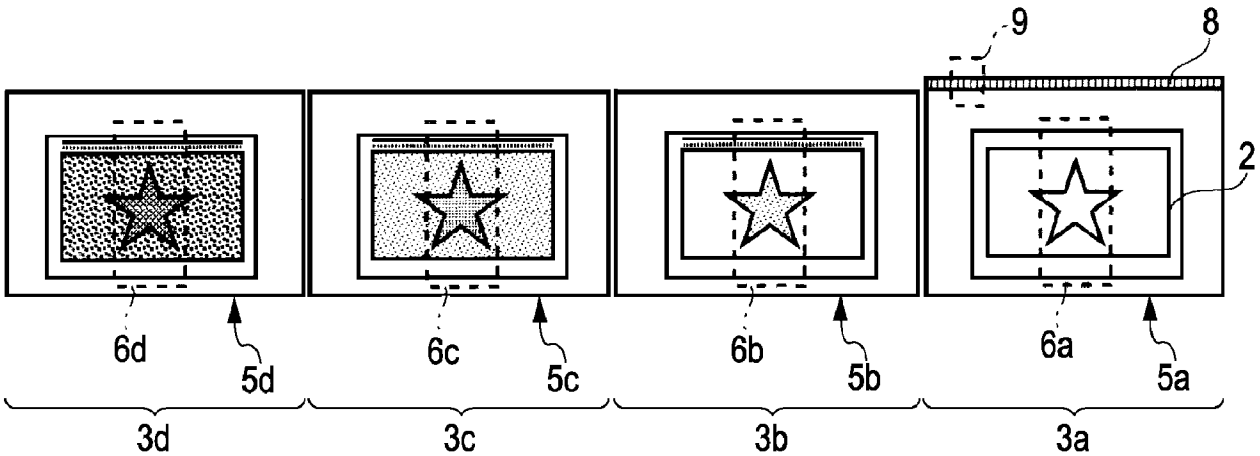

FIGS. 1A and 1B are schematic diagrams showing the configuration of a printer 1 according to this embodiment. FIG. 1A shows the disposition configuration in a case where the printer 1 is viewed from a side, and FIG. 1B shows a planar disposition configuration in a case where the printer 1 is viewed from the top. In the printer 1 shown as an example, a plurality of (in this example, four) ejection stages 3*a* to 3*d* are arranged along the transport path (a second direction) of a recording sheet 2 that is one type of a landing target. The printer 1 has transport mechanisms 5*a* to 5*d* (one type of transport unit) formed of an endless belt (transport belt) 4 that transports the recording sheet 2 and the like and record heads 6*a* to 6*d* (corresponds to liquid ejecting heads according to an embodiment of the invention) corresponding to colors of black K, cyan C, magenta M, and yellow Y for each of the ejection stages 3. The printer 1 is configured to record an image or the like in an image forming area 2*a* (see FIG. 8) of the recording sheet 2 in each ejection stage 3 by using a record head 6 by sequentially transporting the recording sheet 2 to each of the ejection stages 3 by using the transport mechanism 5 and transferring the recording sheet 2 between transport belts 4*a* to 4*d* of the ejection stages 3. Each of the "ejection stages" represents a stage in which record heads 6*a* to 6*d* of each color perform print operations.

The transport mechanism 5 includes a driving roller 7*a*, a driven roller 7*b*, an endless belt 4 that is suspended over the rollers 7*a* and 7*b*, a driving motor (not shown) used for driving the driving roller 7*a* to rotate, and the like. This transport mechanism 5 is configured to send the recording sheet 2 that is placed on the endless belt 4 to the downstream side that becomes the rear side of the transport direction by suspending the endless belt 4 over the driving roller 7*a* and the driven roller 7*b* and rotating the driving roller 7*a* by using the driving motor so as to drive the endless belt 4.

In the transport mechanism 5 of a first ejection stage 3*a*, a linear scale 8 and a linear encoder 9 (corresponding to an encoder pulse outputting unit according to an embodiment of the invention) having a sensor unit that optically detects a scale pattern of the linear scale 8 are disposed. The linear scale 8 is a band-shaped member disposed to rotate together with the endless belt 4. For example, the linear scale is configured by forming a plurality of stripes 8*b* traversing in the width direction of the band on a surface of a transparent base film 8*a* in a scale pattern (see FIGS. 6A to 6E). The stripes 8*b* have a same width and are formed at a predetermined pitch in the longitudinal direction of the band.

Figures 6A, 6B, 6C, 6D, 6E:
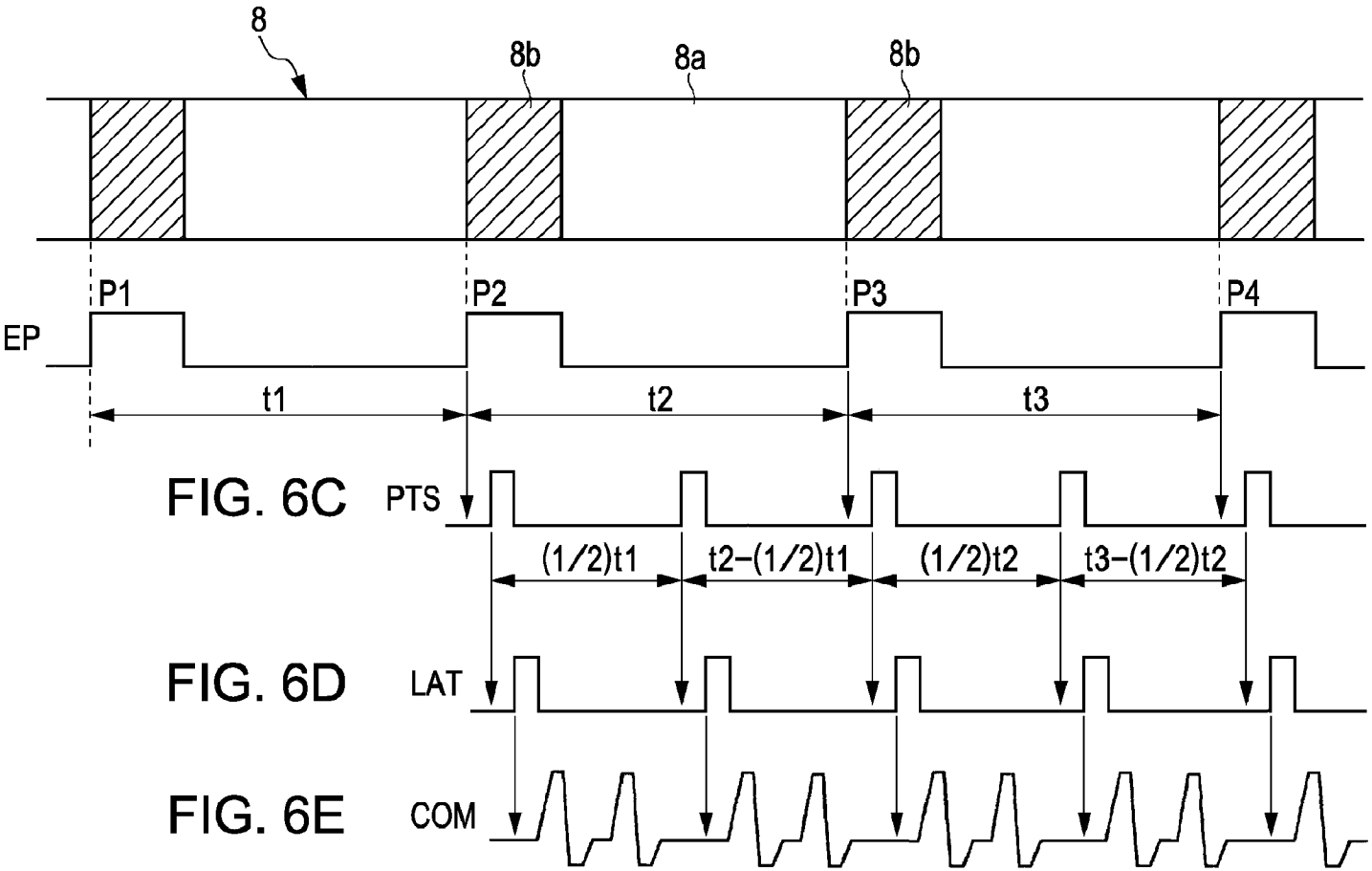
FIGS. 6A to 6E are timing charts for ejection control of a record head in a first ejection stage according to an embodiment of the invention.

The scale pattern of the linear scale 8 is detected by the linear encoder 9. The linear encoder 9 has a light emitting element and a light receiving element that are not shown in the figure, and the linear scale 8 is disposed therebetween. Thus, a detection signal (an encoder pulse EP) transmitted from the light receiving element has different output levels for a case where light emitted from the light emitting element is transmitted through the linear scale 8 and a case where the stripe 8*b* of the scale pattern blocks the light emitted from the light emitting element. In this embodiment, as shown in FIG. 6B, in a light shielding state in which the stripe 8*b* blocks the light from the light emitting element, the output from the light receiving element becomes level H. In addition, in a state that the light emitted from the light emitting element is projected onto a transparent part of the scale pattern, the light is transmitted through the base film 8*a* and is received by the light receiving element. Accordingly, in this state, the output from the light receiving element becomes level L. As a result, in a cycle synchronized with rotation of the endless belt 4, a pulse-shaped signal is output as the encoder pulse EP from the linear encoder 9.

Here, in the scale pattern, the stripes 8*b* having a same width are formed at a predetermined pitch. Thus, when the moving speed of the endless belt 4 is fixed, as shown in FIG. 6B, the encoder pulse EP is output for each predetermined cycle. A control unit 35 of a printer controller 30 to be described later controls an ejection operation of the record head 6*a* in the first ejection stage 3*a* for the recording sheet 2 by using the encoder pulse EP as a reference. In addition, ejection operations in ejection stages 3*b* to 3*d* that are located on the downstream side relative to the first ejection stage 3*a* are controlled based on a timing correction pattern and a meandering correction pattern that are formed on the recording sheet 2 in the first ejection stage 3*a*. This point will be described later in detail.

Next, the record head 6 will be described with reference to FIGS. 2 and 3.

Figure 2:
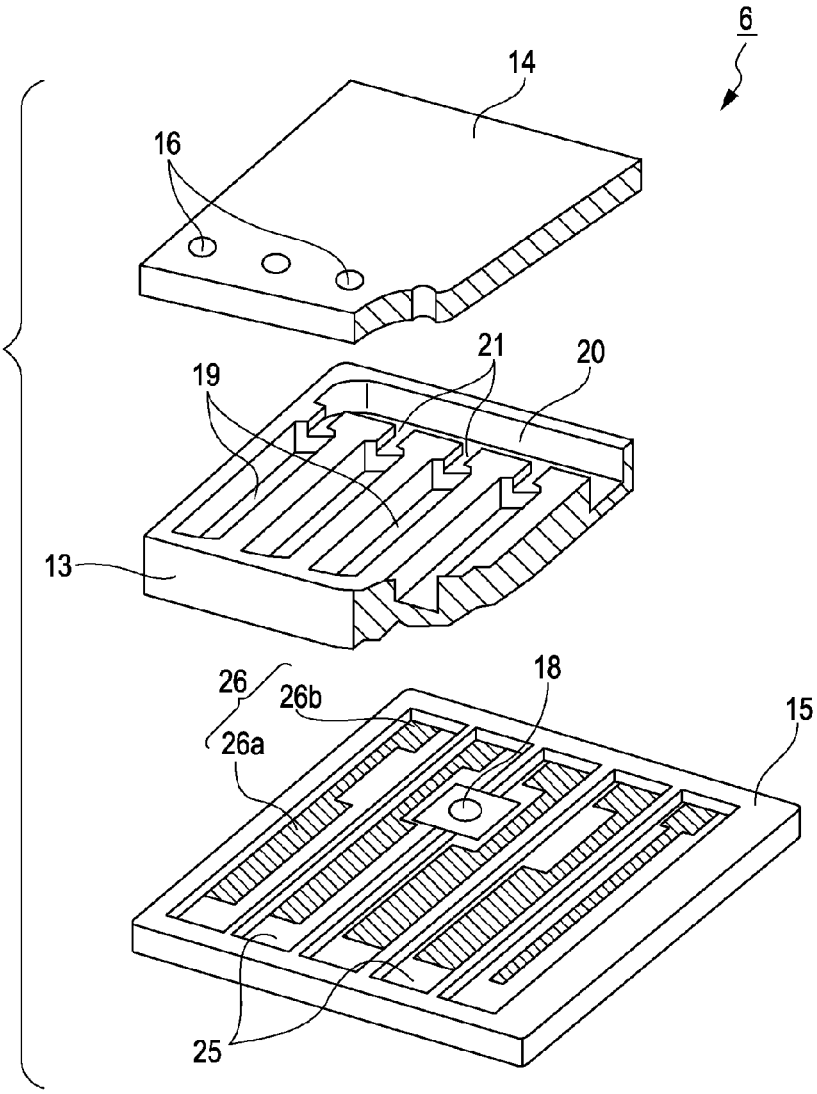
FIG. 2 is an exploded perspective view showing the configuration of major parts of a record head according to an embodiment of the invention.
Figure 3:
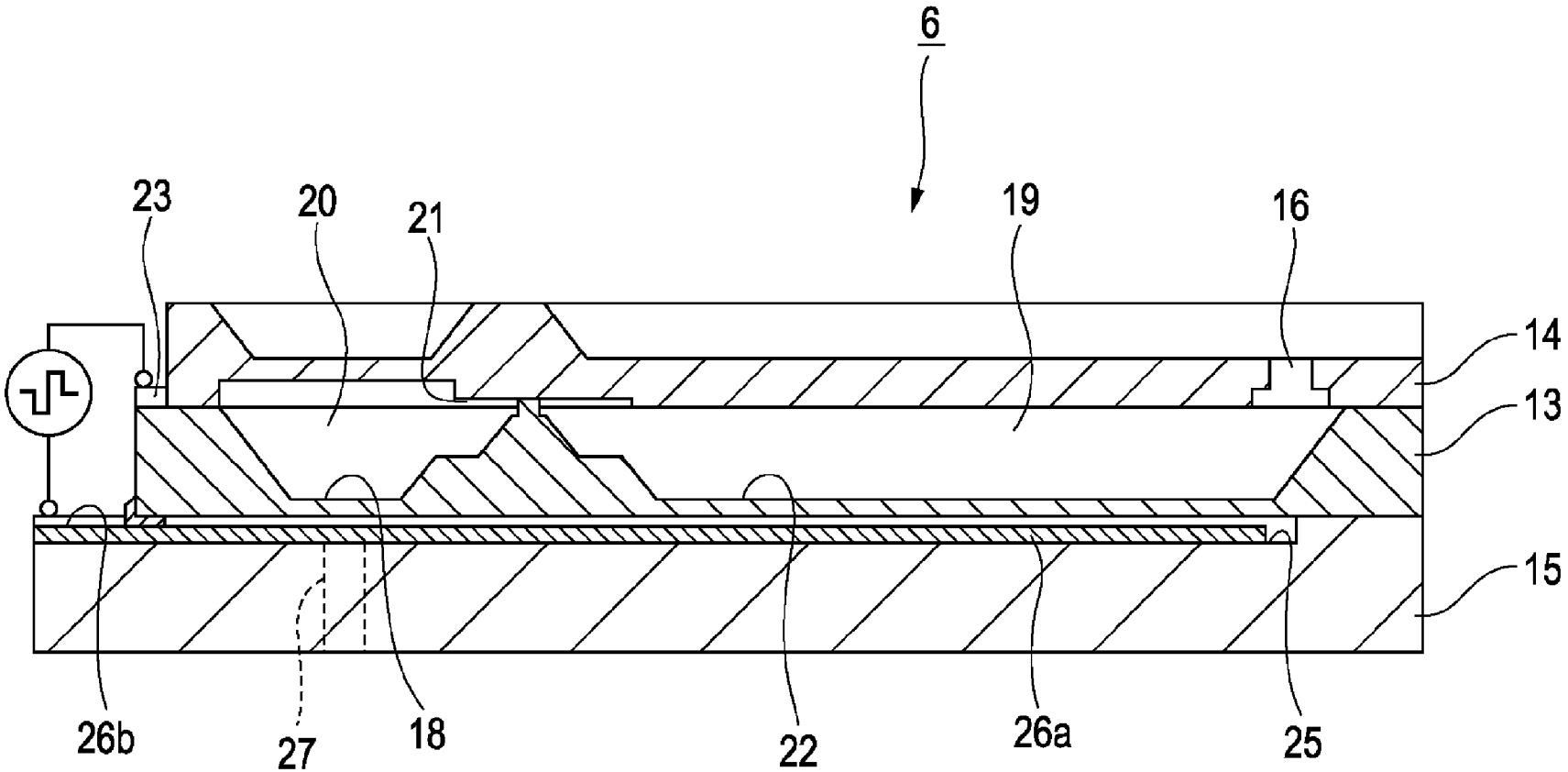
FIG. 3 is a cross-section view of major parts of a record head according to an embodiment of the invention.

FIG. 2 is an exploded perspective view showing the configuration of major parts of the record head 6 according to this embodiment. FIG. 3 is a cross-section view of major parts of the record head 6 in the longitudinal direction of a pressure chamber. The exemplified record head 6 is configured as a long line-type head in which a nozzle group is disposed to have a length corresponding to the maximum recording width of the recording sheet 2 at a predetermined pitch. The direction in which the record head is disposed to have a length corresponding to the maximum recording width is set as a first direction according to an embodiment of the invention. The record head 6 has a three-layer structure by disposing a nozzle forming substrate 14 on one face of a flow path forming substrate 13 to be laminated, disposing an electrode substrate 15 on the other face of the flow path forming substrate 13 to be laminated, and bonding the substrates by using an adhesive agent.

Figure 4:
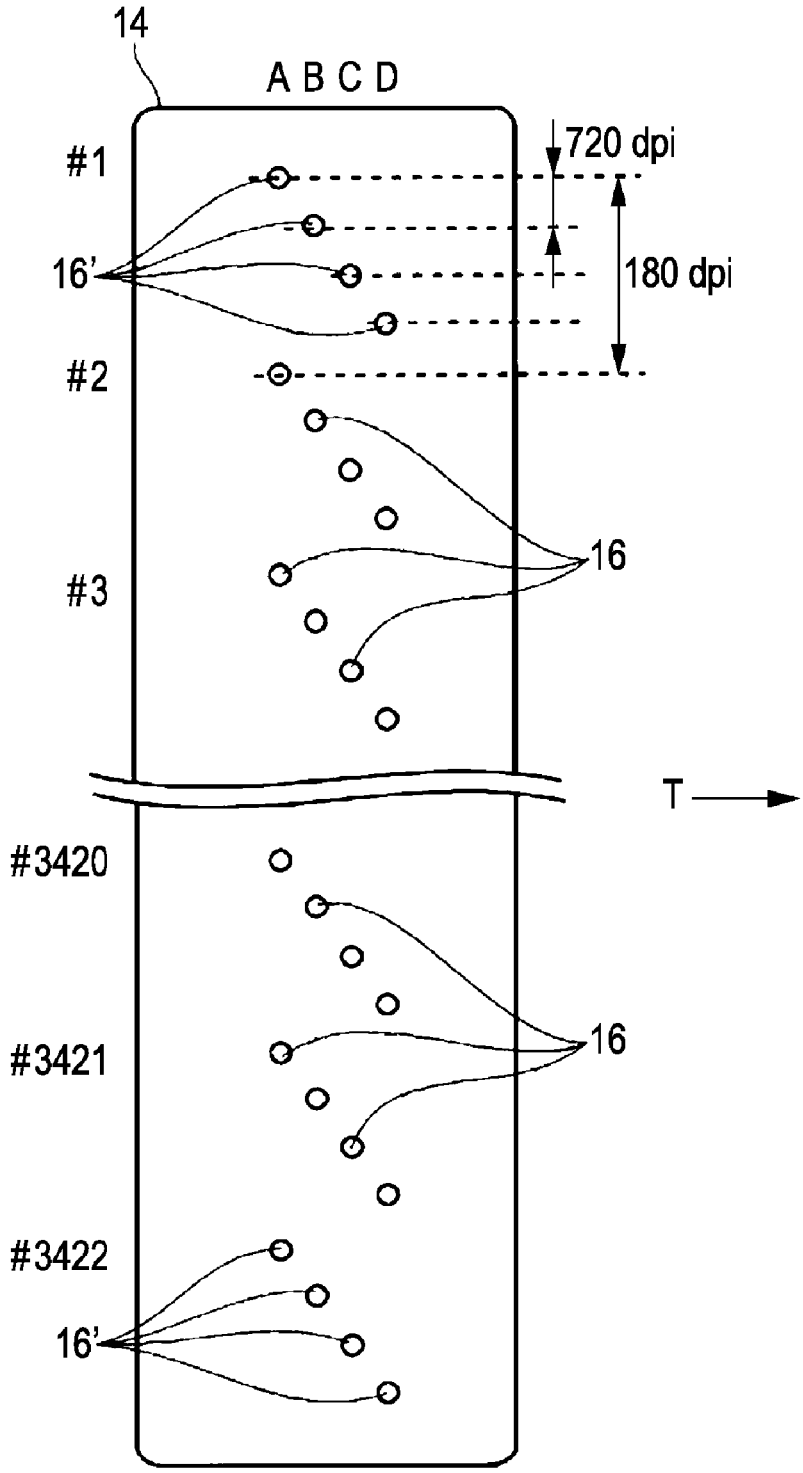
FIG. 4 is a plan view showing the configuration of a nozzle forming substrate according to an embodiment of the invention.

FIG. 4 is a plan view showing the configuration of the nozzle forming substrate 14. In the nozzle forming substrate 14, a plurality of nozzles 16 that ejects ink (one type of the liquid according to an embodiment of the invention) are aligned in the direction perpendicular to the transport direction T of the recording sheet 2 so as to configure a nozzle array (one type of the nozzle group), and four rows of the nozzle arrays including A to D are formed in the transport direction. In this embodiment, one nozzle array is configured by 3,422 nozzles 16 established at a pitch of 180 dpi. In addition, each nozzle array is disposed to be deviated relative to the alignment direction of the nozzle array such that pitch of the nozzles 16 between adjacent nozzle arrays in the alignment direction of the nozzles becomes 720 dpi. Accordingly, the record head 6 according to this embodiment has a total of 13,688 nozzles 16 at a pitch of 720 dpi viewed from the alignment direction of the nozzles. Among these nozzles 16, four nozzles disposed in each of both end parts in the alignment direction of the nozzles so as to configure a total of 8 nozzles 16 serve as preliminary nozzles 16' corresponding to an area outside the image forming area (corresponds to a regulated landing area according to an embodiment of the invention) of the maximum-sized recording sheet 2 among recording sheets that can be used in the printer 1. In addition, the configuration of the nozzle 16 is the same as that of the nozzle 16'. In addition, the number of the nozzles 16 that serve as the preliminary nozzles 16' varies depending on the size of the recording sheet 2 and the size of the image forming area.

In the flow path forming substrate 13, a groove part that becomes a flow path of ink is formed by performing anisotropic etching from the surface. By covering an opening portion of the groove part with the nozzle forming substrate 14, a series of ink flow path that is formed of a plurality of pressure chambers 19 disposed in correspondence with the nozzles 16, a common ink chamber 20 (common liquid chamber) into which ink common to the pressure chambers is introduced, and an ink supply path 21 that communicates with the common ink chamber 20 and the pressure chambers 19 is partitioned.

In the flow path forming substrate 13, on the bottom face of the groove part that becomes the common ink chamber 20, an ink introducing opening 18 that perforates the bottom face in the direction of thickness of the substrate is formed. In addition, on the bottom face of the groove part that becomes the pressure chambers 19, a thin-walled part 22 that serves as an elastic face that can be elastically displaced in the direction (the vertical direction in FIG. 3) of stacking the head is formed. In the flow path forming substrate 13, a common electrode terminal 23 is formed. Since the flow path forming substrate 13 has conductivity, the thin-walled part 22 is configured to additionally serve as a common electrode.

On a face of the electrode substrate 15 that is bonded to the flow path forming substrate 13, in a position facing the thin-walled part 22 of the pressure chamber 19, a concave part 25 that is etched shallow in a tray shape is formed in correspondence with each pressure chamber 19. On the bottom face of the concave part 25, individual electrodes 26 are disposed. Each individual electrode 26 is configured by a segment electrode 26*a* that extends in correspondence with each pressure chamber 19 and an electrode terminal part 26*b* that is exposed externally. When the electrode substrate 15 is bonded to the flow path forming substrate 13, the thin-walled part 22 of each pressure chamber 19 and the segment electrode 26*a* of each individual electrode 26 face each other with a narrow gap formed therebetween.

In addition, in the electrode substrate 15, an ink introducing path 27 that perforates the electrode substrate in the direction of thickness of the substrate is formed. The ink introducing path 27 is configured to be communicated with the ink introducing opening 18 in a state that the electrode substrate is bonded to the flow path forming substrate 13. Through the ink introducing path 27 and the ink introducing opening 18, ink is introduced into the common ink chamber 20, for example, from an ink tank (not shown) that is disposed on a printer main body side. The ink inside the common ink chamber 20 passes through the ink supply path 21 that is branched from the common ink chamber 20 and is distributed and supplied to each pressure chamber 19.

Between the common electrode terminal 23 of the flow path forming substrate 13 and the individual electrode 26 of the electrode substrate 15, a driving voltage (driving signal COM) is applied from the printer controller 30 side. By changing the driving voltage to the positive side relative to a reference voltage, an electrostatic force is generated between the thin-walled part 22 serving as the common electrode and the individual electrode 26. Then, the thin-walled part 22 is elastically transformed depending on the electrostatic force so as to be bent to the individual electrode 26 side. Accordingly, the thin-walled part is adsorbed to the surface of the segment electrode 26*a*. As a result, the volume of the pressure chamber 19 increases, and accordingly, ink flows into the pressure chamber 19 from the common ink chamber 20 side through the ink supply path 21. Then, when the driving voltage rapidly changes to the negative side so as to decrease the electrostatic force, the thin-walled part 22 is detached from the surface of the segment electrode 26*a* by the elastic force so as to be displaced to the pressure chamber 19 side. As a result, the volume of the pressure chamber 19 decreases rapidly. Accordingly, a pressure change is generated in the ink inside the pressure chamber 19, and ink is emitted (ejected) from the nozzle 16 in accordance with the pressure change.

Figure 5:
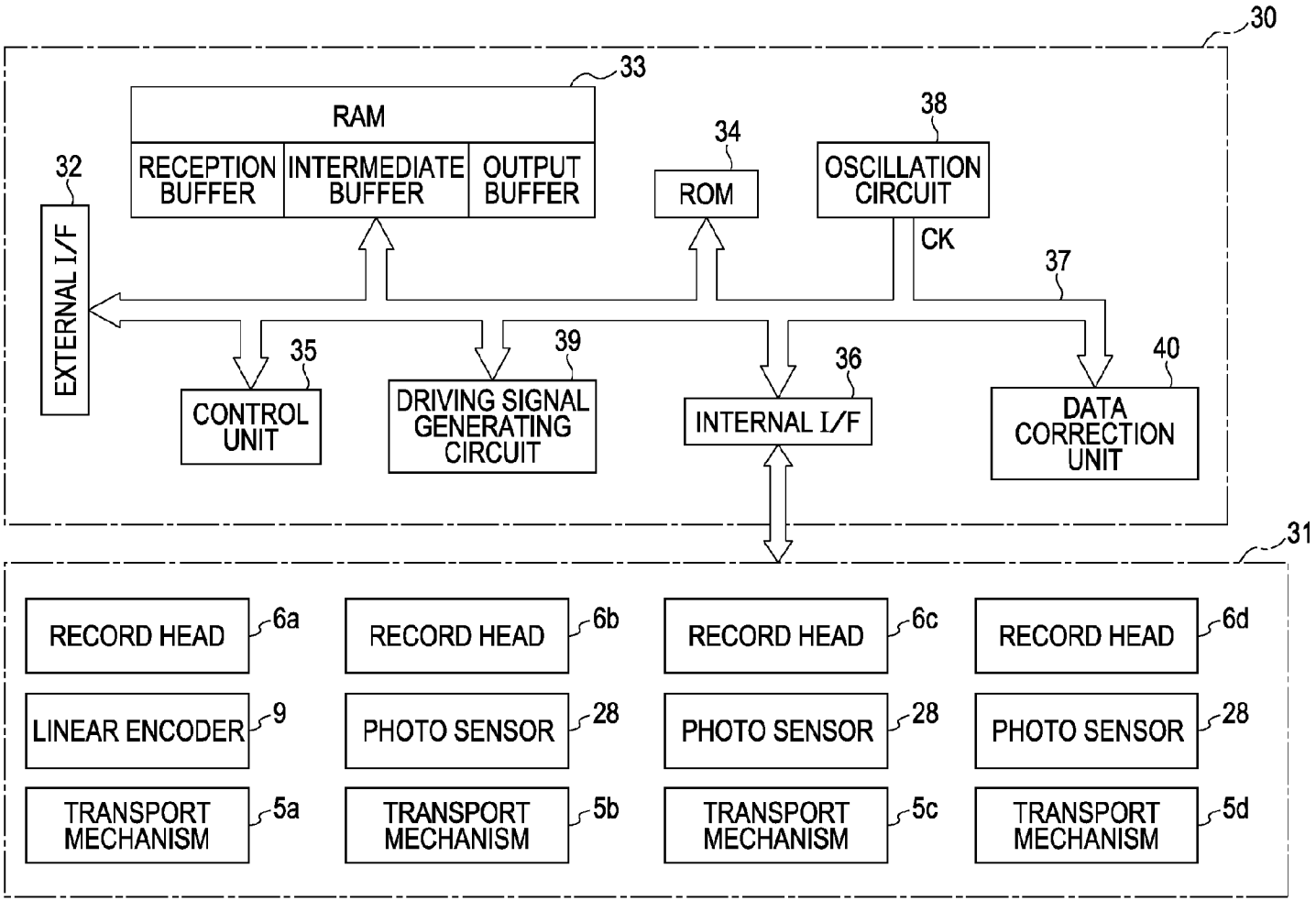
FIG. 5 is a block diagram showing the electrical configuration of a printer according to an embodiment of the invention.

FIG. 5 is a block diagram showing the electrical configuration of the printer 1. The printer 1 includes the printer controller 30 and a print engine 31. The printer controller 30 is configured by an external interface (external I/F) 32 that receives print data or the like from an external device such as a host computer not shown in the figure, a RAM 33 that stores various data, a ROM 34 that stores a routine used for various data processes and the like, a CPU, and the like. The printer controller 30 has a control unit 35 that performs an electrical control operation for each constituent unit and an internal interface (internal I/F) 36 that is used for transmitting ejection serial data, a driving signal, and the like to the print engine 31 side in a state that the control unit and the internal interface are connected to each other through an internal bus 37. In addition, the printer controller 30 includes an oscillation circuit 38 that generates a clock signal CK, a driving signal generating circuit 39 that generates a driving signal (COM) to be supplied to the record head 6, and a data correction unit 40 that corrects the ejection serial data that is transmitted to the record head 6.

In this embodiment, the print data represents multi-gray scale image data of RGB that is transmitted from an external device to the printer 1. In addition, the ejection serial data represents serial data that is expanded based on the print data and transmitted to the record head 6.

The RAM 33 is used as a reception buffer, an intermediate buffer, an output buffer, a work memory (not shown), or the like. In the reception buffer, the print data, which is received by the external I/F 32, from the external device is stored temporarily. In the intermediate buffer, intermediate code data that has been converted by the control unit 35 is stored. In addition, in the output buffer, the ejection serial data that is transmitted to the record head 6 is expanded. The ROM 34 stores various control routines that is performed by the control unit 35, font data, a graphic function, various procedures, and the like.

The control unit 35 expands the print data transmitted from the host computer or the like into the ejection serial data corresponding to each nozzle 16 (16') of the record head 6 and transmits the ejection serial data to the record head 6. In such a case, the control unit 35 reads out the print data stored in the reception buffer, converts the print data into the intermediate code data, and stores the intermediate code data in the intermediate buffer. Then, the control unit 35 analyses the intermediate code data read out from the intermediate buffer and expands the intermediate code data into the ejection serial data for each dot size by referring to the font data or the graphic function stored in the ROM 34. In this embodiment, the ejection serial data is configured by binary serial data (raster data) that represents ejection or non-ejection of each nozzle 16 (16').

The ejection serial data expanded based on the print data is stored in the output buffer of the RAM 33. When the ejection serial data SI for one line (entire nozzles of the record head 6) is acquired, the ejection serial data is transmitted to the record head 6 through the internal I/F 36 in a serial mode. In addition, according to this embodiment, the record head 6 as the destination of transmission is different in accordance with the color of the ejection serial data. In other words, the ejection serial data corresponding to black K is transmitted to the record head 6*a* that is disposed in the first ejection stage 3*a*.

Then, when the ejection serial data for one line (one raster) is transmitted from the output buffer, the content of the intermediate buffer is erased, and a conversion process for the next intermediate code data is performed. Then, in the record head 6, ink ejecting operations from each nozzle 16 are performed based on the received ejection serial data.

Figures 7A, 7B, 7C, 7D, 7E, 7F:
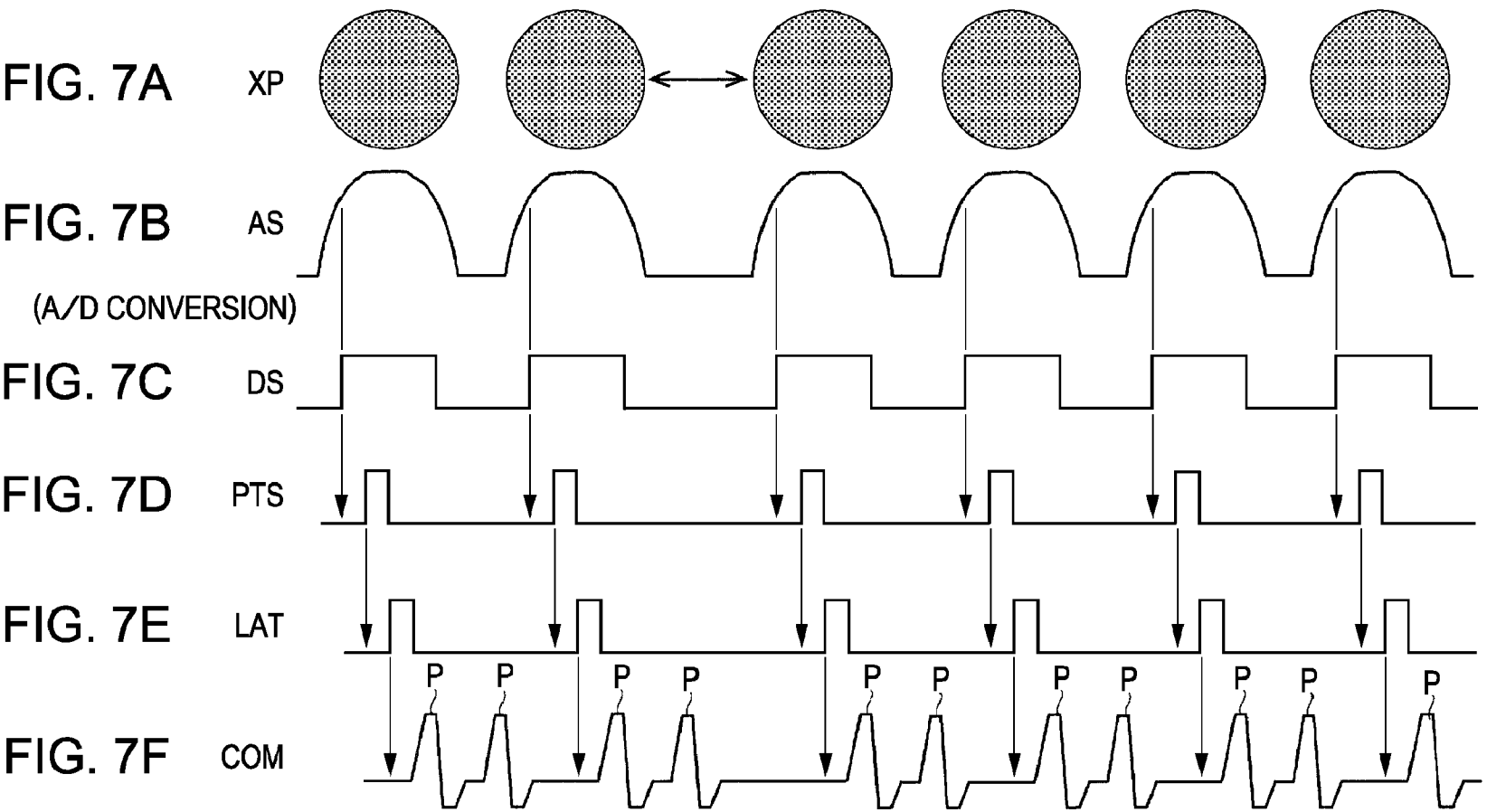
FIGS. 7A to 7F are timing charts for ejection control performed based on a timing correction pattern according to an embodiment of the invention.

The above-described driving signal generating circuit 39 generates a driving signal COM to be supplied to the record head 6 under the control of the control unit 35. The driving signal COM, as shown in FIGS. 6E and 7F, is a series of signals configured by a driving pulse P that is disposed within one ejection cycle (one recording cycle). The driving signal is applied between the individual electrode 26 of the record head 6 and the common electrode terminal 23. Each time the driving pulse P is applied, ink is ejected from the nozzle 16 (16'). The application of the driving pulse P is performed in accordance with a value "1" of the ejection serial data which represents ejection. On the other hand, the driving pulse P is not applied between the individual electrode 26 and the common electrode terminal 23 when the value of the ejection serial data is "0" that represents non-ejection.

The above-described print engine 31 is configured by the record heads 6 (6*a* to 6*d*) that are disposed for each ejection stage 3, an electric driving system of the transport mechanisms 5 (5*a* to 5*d*), and the like. In addition, in the print engine 31, the linear encoder 9 that is disposed in the first ejection stage 3*a* and photo sensors 28 that are disposed in the second ejection stage 3*b* to the fourth ejection stage 3*d* are included.

Figure 8:
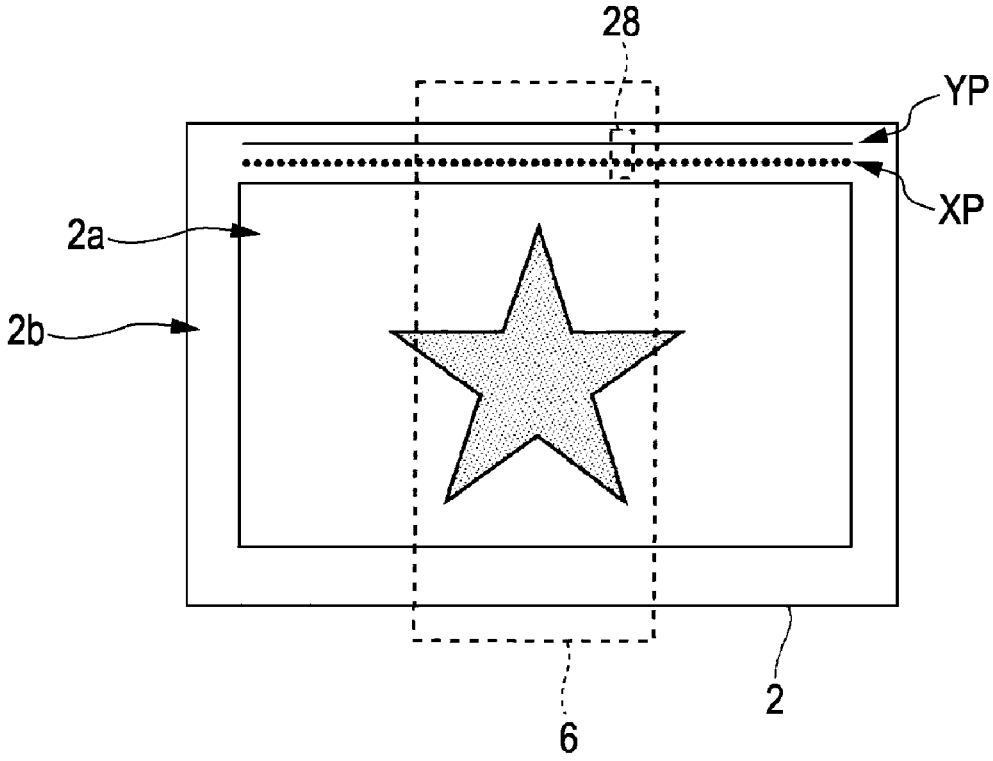
FIG. 8 is a diagram showing the configuration of an image forming area, a margin, a timing correction pattern, and a meandering correction pattern on a recording sheet according to an embodiment of the invention.
Figure 9:
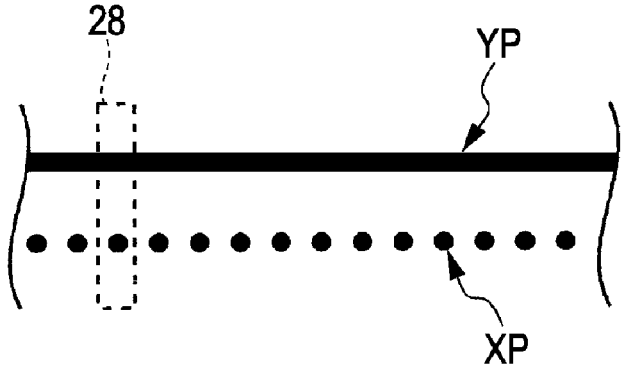
FIG. 9 is a diagram showing an enlarged view of the timing correction pattern and the meandering correction pattern shown in FIG. 8.

The photo sensors 28 of the record heads 6*b* to 6*d* among the record heads 6*a* to 6*d* except for the record head 6*a* disposed in the first ejection stage 3*a* are disposed for detecting a timing correction pattern and a meandering correction pattern to be described later. In other words, the photo sensor 28 serves as a meandering correction pattern detecting unit and a timing correction pattern detecting unit according to an embodiment of the invention. The photo sensor 28 includes a light emitting element and a light receiving element. As shown in FIGS. 8 and 9, the photo sensor is disposed on an upper side of a position corresponding to a pass band of the timing correction pattern XP and the meandering correction pattern YP that are printed on the recording sheet 2 in the first ejection stage 3*a*.

In addition, the photo sensor 28 is configured to project light on a print surface of the recording sheet 2 from the light emitting element and receive reflective light reflected from the print surface by using the light receiving element. The intensity of the reflective light reflected from the print surface of the recording sheet 2 is different for a part in which the correction patterns XP and YP are printed and a part in which the correction patterns are not printed. Accordingly, the output level of the detection signal transmitted from the light receiving element is different in a state that the correction patterns are projected and a state that the correction patterns are not projected. Then, the detection signal AS (analog data) transmitted from the light receiving element is converted into analog from digital to be output to the printer controller 30 side as a detection signal DS (digital data).

In addition, the photo sensor 28, as shown in FIG. 10, can detect the positional deviation of the meandering correction pattern YP in the direction perpendicular to the transport direction (the direction of alignment of nozzles) based on a light receiving position of the light receiving element CCD for the reflective light. Thus, in the detection signal DS output from the photo sensor 28, the detection position information is included.

In the printer 1 configured as described above, the recording sheet 2 is transported by driving the transport units 5*a* to 5*d*, and an image or the like is recorded by landing ink for each color in the recording sheet 2 by using the record heads 6 in each ejection stage 3 while sequentially transferring the recording sheet 2 among the endless belts 4*a* to 4*d*. In such a configuration, there is a case where the transport speed of the recording sheet 2 changes or positions in the direction (the direction of the nozzle array) perpendicular to the transport direction are deviated from one another, due to a mechanical error of the transport mechanism 5 or the like. Accordingly, when no countermeasure is taken, landing positions of ink in the recording sheet 2 may be deviated from one another among the ejection stages. As a result, there is a possibility that the image quality of the recorded image deteriorates.

Thus, in the printer 1 according to an embodiment of the invention, in the first ejection stage 3*a*, as shown in FIG. 8, a timing correction pattern XP and a meandering correction pattern YP are formed in the margin 2*b* outside the image forming area 2*a* of the recording sheet 2. In addition, in the ejection stages 3*b* to 3*d* located on the downstream side that is next to the first ejection stage 3*a* in the transport direction, ejection control is performed by using the record heads 6*b* to 6*d* based on the correction patterns, so that the deviations of ink landing positions in the recording sheet 2 are prevented. Hereinafter, this point will be described.

First, ejection control of the record head 6*a* in the first ejection stage 3*a* will be described.

FIGS. 6A to 6E are timing charts for ejection control of the record head 6*a* in the first ejection stage 3*a*. In the first ejection stage 3*a*, as described above, by detecting the scale pattern (FIG. 6A) of the linear scale 8, a recording operation (ejection operation) in the first ejection stage 3*a* for the recoding sheet 2 is controlled with reference to the encoder pulse EP (FIG. 6B) that is output from the linear encoder 9. Accordingly, transport of the recording sheet 2 by using the transport mechanism 5*a* and the ink ejecting operation by using the record head 6*a* are synchronized.

The encoder pulse EP transmitted from the linear encoder 9 is output to the control unit 35 of the printer controller 30. When receiving the encoder pulse EP, the control unit 35 serves as a timing pulse generating unit according to an embodiment of the invention and generates a timing pulse PTS (FIG. 6C) from the encoder pulse EP. This timing pulse PTS is a signal used for setting an output timing of the driving signal COM (FIG. 6E) that is generated by the driving signal generating circuit 39. In other words, each time the timing pulse PTS is received, the driving signal generating circuit 39 outputs the driving signal COM of a unit cycle. In addition, the serial clock pulse CK is generated based on the timing pulse PTS, and the ejection serial data is configured to be transmitted to the record head 6 at a timing synchronized with the serial clock pulse CK.

When, for example, the interval of the encoder pulses EP corresponds to 360 dpi and the timing pulses PTS are output at intervals corresponding to 720 dpi, the control unit 35 generates the timing pulse PTS by multiplying the received frequency of the encoder pulse EP. For example, as shown in FIG. 6C, when receiving the encoder pulse EP, the control unit 35 acquires a cycle of generation of the timing pulse PTS by multiplying an interval t between the encoder pulse EP received one encoder pulse before and the encoder pulse EP currently received by ½. Then, the control unit generates the timing pulse PTS in accordance with the cycle of generation.

When receiving the timing pulse PTS from the control unit 35, the driving signal generating circuit 39 outputs a latch pulse LAT (FIG. 6D) and the driving signal COM (FIG. 6E).

The latch pulse LAT and the driving signal COM are transmitted to the record head 6 though the internal I/F 36. Then, the record head 6 latches the ejection serial data received from the printer controller 30 side at a timing on the basis of the latch pulse LAT, performs switching control in accordance with information (that is, "1" or "0") representing ejection or non-ejection of the latched ejection serial data, and thereby controls application or non-application of the driving signal COM to the common electrode terminal 23 and the individual electrode 26. As a result, ejection of ink from each nozzle 16 (16') is controlled in a state synchronized with the transport of the recording sheet 2 performed by the transport mechanism 5*a*.

Here, in the first ejection stage 3*a*, the timing correction pattern XP and the meandering correction pattern YP are formed in the margin of the recording sheet 2 along the transport direction. In other words, the correction unit 40 serves as a timing correction pattern forming unit and a meandering correction pattern forming unit according to an embodiment of the invention. When expanding the ejection serial data (in this embodiment, the ejection serial data corresponding to black) to be transmitted to the record head 6*a*, the correction unit adds correction pattern data used for driving the preliminary nozzle 16' corresponding to the margin located outside the image forming area of the recording sheet 2. Accordingly, in the recording operation of the record head 6*a*, as shown in FIGS. 8 and 9, ink is ejected from the preliminary nozzle 16' based on the correction pattern data, and the timing correction pattern XP and the meandering correction pattern YP are formed in the margin of the recording sheet 2 along the transport direction. The timing correction pattern XP is configured by a plurality of dots aligned along the transport direction of the recording sheet 2, and a pitch of formed dots is adjusted to the disposition pitch of the scale patterns of the linear scale 8. On the other hand, the meandering correction pattern YP is configured as a continuous straight line along the transport direction. In addition, the timing correction pattern XP may be additionally used as the meandering correction pattern YP.

Accordingly, the recoding sheet 2 on which the image and the correction patterns XP and YP are formed in the first ejection stage 3*a* is sequentially sent to the ejection stages 3*b* to 3*d* located on the downstream side. In the ejection stages 3*b* to 3*d*, the correction patterns XP and YP that have been printed on the recording sheet 2 in the first ejection stage 3*a* are detected by the photo sensor 28, and correction of landing positions of ink is performed based on the detection signals.

First, correction of landing positions of ink for positional deviations in the transport direction of the recording sheet 2 will be described with reference to FIGS. 7A to 7F.

FIGS. 7A to 7F are timing charts for ejection control performed based on the timing correction pattern XP. In the ejection stages 3*b* to 3*d*, by detecting the timing correction pattern XP (FIG. 7A) formed on the recording sheet 2, the recording operation for the recording sheet 2 is controlled based on the detection signal DS (FIG. 7C) that can be acquired by converting the detection signal AS (FIG. 7B) output from the photo sensor 28 to digital from analog.

In other words, the control unit 35 serving as the timing pulse generating unit generates the timing pulse PTS (FIG. 7D) based on the detection signal DS instead of the encoder pulse EP. In addition, when receiving the timing pulse PTS from the control unit 35, the driving signal generating circuit 39 outputs the latch pulse LAT (FIG. 7D) and the driving signal COM (FIG. 7E). Accordingly, ejection of ink from each nozzle 16 (16') of the record heads 6 (6*b* to 6*d*) is controlled in a state synchronized with transport of the recording sheet 2 performed by the transport mechanism 5*a*. In other words, for example, when the transport speed of the recording sheet 2 becomes slower than its original timing between the second timing correction pattern XP and the third timing correction pattern XP shown in FIG. 7A, the timing of ink ejection from the nozzles 16 (16') is delayed in accordance with the transport speed. To the contrary, when the transport speed of the recording sheet 2 becomes faster than the original timing, the timing of ink ejection from the nozzles 16 (16') can advance in accordance with the transport speed. Accordingly, even when an error of the transport speed of the recording sheet 2 is generated among the ejection stages, deviations of landing positions of ink in the recording sheet 2 in the transport direction can be suppressed.

Next, the correction of ink landing positions in a case where deviations in the direction (the direction of alignment of nozzles) perpendicular to the transport direction are generated at a time when the recording sheet 2 is transferred among the ejection stages will be described.

Figure 10A:
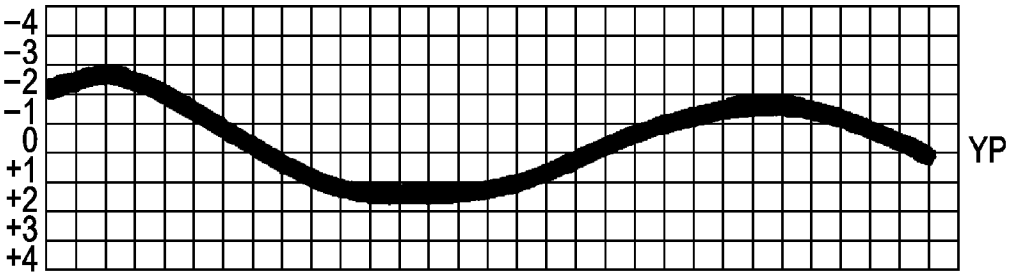
FIGS. 10A and 10B are diagrams showing an example of detection by using a photo sensor according to an embodiment of the invention.
Figure 10B:
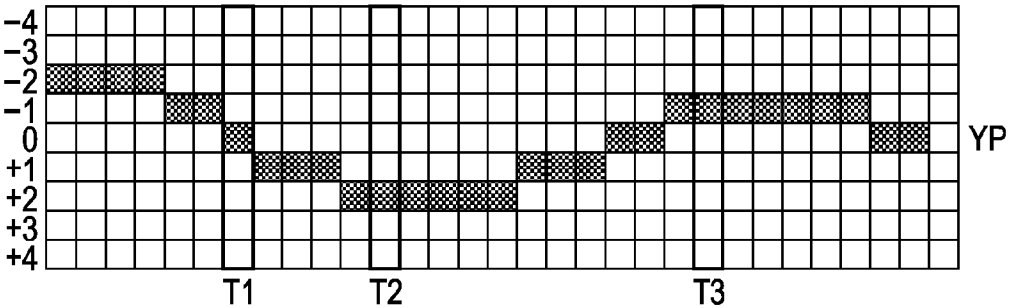
Figure 11:
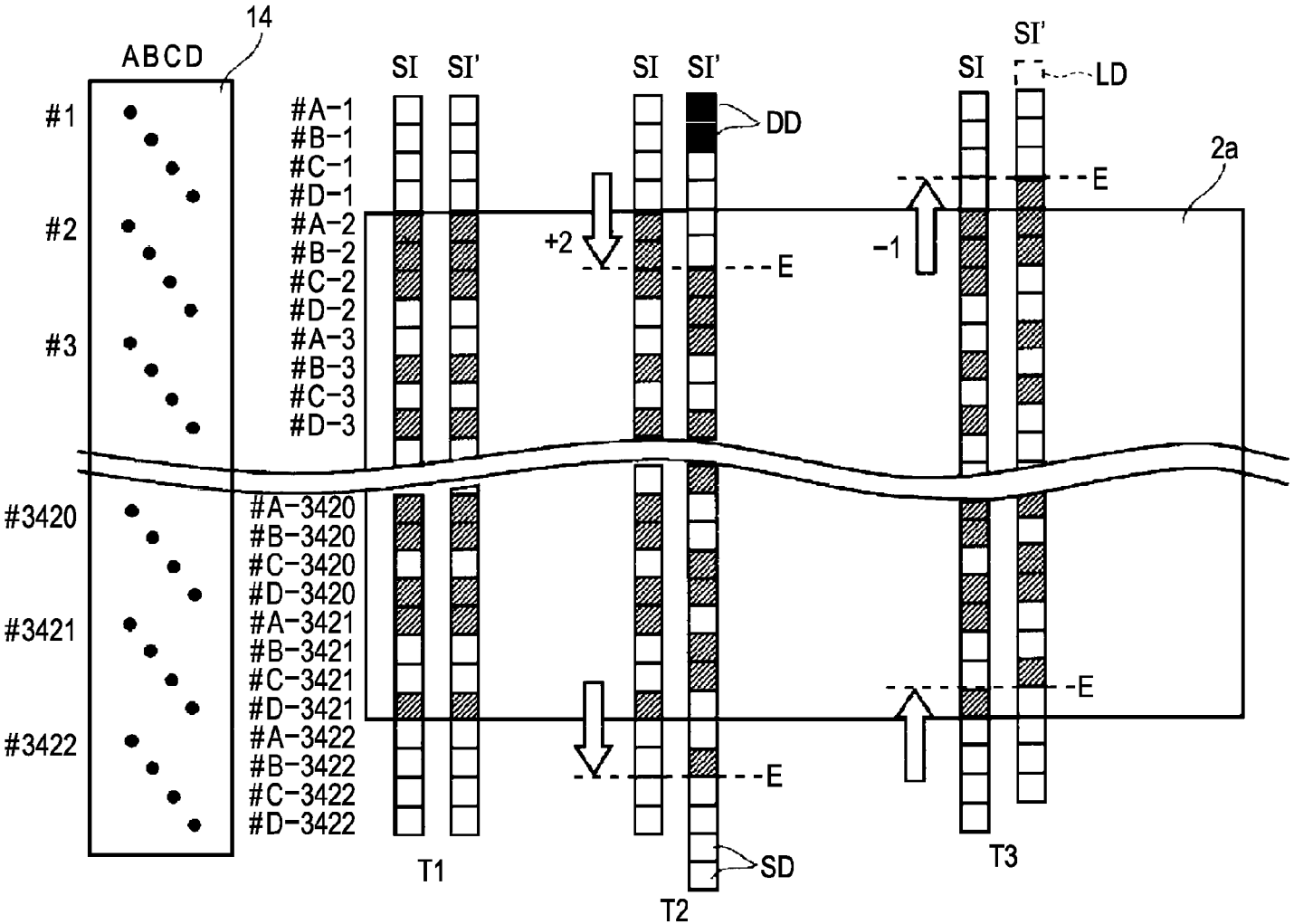
FIG. 11 is a schematic diagram for describing correction of ejection serial data according to an embodiment of the invention.
Figure 12A:
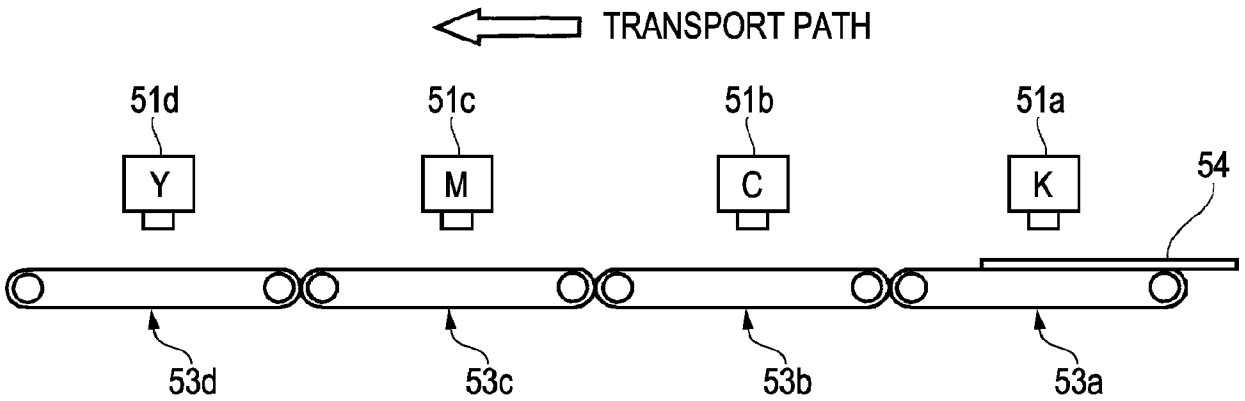
FIGS. 12A and 12B are diagrams showing the configuration of a general printer.
Figure 12B:
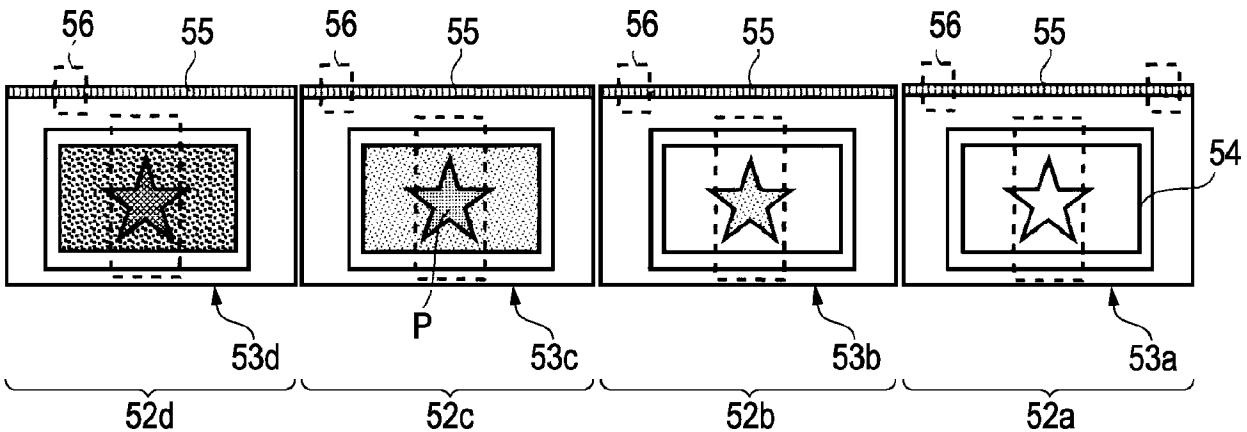
Figure 13A:
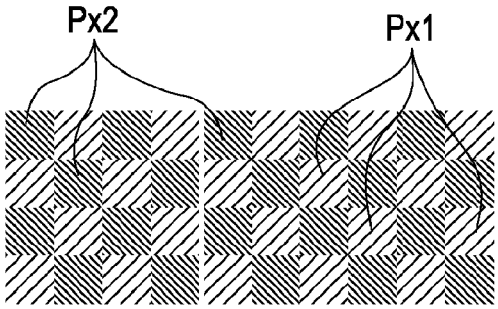
FIGS. 13A to 13D are enlarged diagrams of an image recorded by a general printer.
Figure 13B:
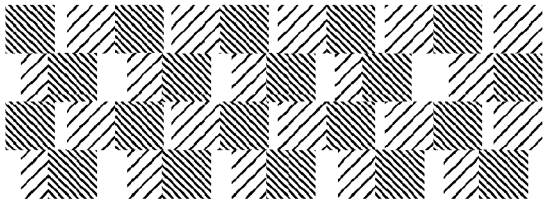
Figure 13C:
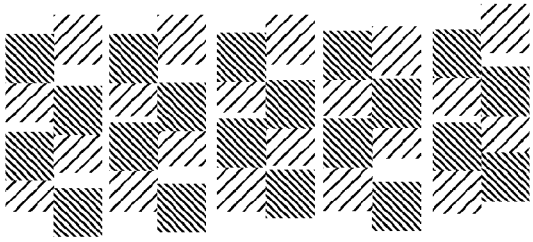
Figure 13D:
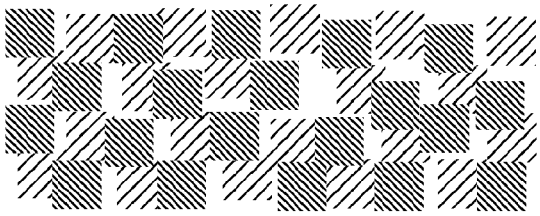

FIGS. 10A and 10B are diagrams showing an example of detection by using the photo sensor 28. FIG. 10A represents an analog signal state, and FIG. 10B represents a digital signal state. FIG. 11 is a schematic diagram for describing correction of the ejection serial data. In FIGS. 10A and 10B, the horizontal axis is a time axis, and the vertical axis represents the detection position of the photo sensor 28 in the direction of alignment of the nozzles. A position represented by "0" on the vertical axis in the figure is a reference position (the position of detection of the meandering correction pattern YP in a state that the positional deviation in the direction of alignment of the nozzles is not generated) that is the original position. In this embodiment, the positional deviation of the meandering correction pattern YP to the lower side in the figure is represented by a positive value, and the positional deviation of the meandering correction pattern to the upper side in the figure is represented by a negative value.

In FIG. 11, a part denoted by "2*a*" is the image forming area of the recording sheet 2, and each broken line E shows a part of an edge of the image forming area 2*a* in a case where the positional deviation in the direction of alignment of the nozzles is generated in the recording sheet 2. Furthermore, "SI" and "SI'" are the ejection serial data before correction and the ejection serial data after correction and are schematically shown in accordance with nozzles 16 of the record head 6 and dot forming positions of the image forming area 2*a*. In other words, a rectangle part in SI and SI' shown in the figure represents data corresponding to each pixel (or the nozzle 16 (16')). In the figure, data representing ejection is denoted by a hatched area, and data representing non-ejection is denoted by a blank area.

As described above, the meandering correction pattern YP that is configured as a straight line is detected by the photo sensor 28 that serves as the meandering correction pattern detecting unit. However, when the position of the recording sheet 2 is deviated in the direction of alignment of the nozzles, a meandered state as shown in FIGS. 10A and 10B is detected in a time series. In addition, the amount of the positional deviation of the recording sheet 2 in the direction of alignment of the nozzles can be recognized by acquiring by how many pixels the detection signal DS is deviated from the reference position. For example, at a time point denoted by T1, the positional deviation of the meandering correction pattern YP from the reference position (0) is not generated. In addition, at a time point denoted by T2, the meandering correction pattern YP is deviated from the reference position (0) by two pixels to the lower side (+2). In other words, the image forming area is deviated by two pixels to the lower side in FIG. 11. Furthermore, at a time point denoted by T3, the meandering correction pattern YP is deviated from the reference position (0) by one pixel to the upper side (−1). In other words, the image forming area is deviated by one pixel to the upper side in FIG. 11.

As described above, when the position of the image forming area is deviated in the direction of alignment of the nozzles (the first direction), each record head 6 has a disposition position in the direction of alignment of the nozzles with respect to the printer 1 is fixed. Accordingly, correction of the deviation of the ink landing position corresponding to scanning of the head cannot be made. Thus, the data correction unit 40 serves as a data correction unit according to an embodiment of the invention. When it is determined that the meandering correction pattern YP is deviated from the reference position to one side (in the example shown in FIG. 11, the lower side (+ side)) of the direction of alignment of the nozzles based on the detection signal DS, the data correction unit 40 adds dummy data representing non-ejection corresponding to the amount of the deviation to the front side of the ejection serial data. On the other hand, when the meandering correction pattern YP is deviated from the reference position to the other side (in the example shown in FIG. 11, the upper side (− side)) of the direction of alignment of the nozzles, the data correction unit 40 removes data from the start of the ejection serial data corresponding to the amount of the deviation.

In other words, at the time point of T2 shown in FIG. 10, the meandering correction pattern YP is deviated from the reference position by two pixels to the positive side of the direction of alignment of the nozzles. Accordingly, the data correction unit 40 adds two units of data DD (units of data colored in black in FIG. 11) to the front side of the ejection serial data SI. Then, the ejection serial data SI' after correction corresponding to the number of the total nozzles 16 including the preliminary nozzles 16' is sequentially transmitted to the record head 6 from the front side, and thus, redundant data (data denoted by SD in FIG. 11) pushed out by adding the dummy data DD is automatically removed. Likewise, at the time point of T3 shown in FIG. 11, the meandering correction pattern YP is deviated from the reference position by one pixel to the negative side of the direction of alignment of the nozzles. Accordingly, the data correction unit 40 removes one unit of data (data denoted by LD in FIG. 11) located in the front side of the ejection serial data SI. Accordingly, the ejection serial data SI' after correction is shifted to the front side by one on the whole, compared to the ejection serial data before correction. By shifting by one, data corresponding to the preliminary nozzle 16' (nozzle denoted by #D-3422 in FIG. 11) located on one rear side among the nozzles 16 is missing to be NULL. However, basically NULL represents non-ejection, and thus there is no problem.

As described above, correspondence between each nozzle 16 of the nozzle group and the ejection serial data changes in accordance with the positional deviation of the recording sheet 2 in the direction (the first direction) of alignment of the nozzles. Accordingly, the deviation of ink landing positions in the direction of alignment of the nozzles can be suppressed by performing a simple control operation of addition or removal of data without performing complex control such as re-expanding the ejection serial data. In addition, according to this embodiment, since four preliminary nozzles 16' are disposed on one side and on the other side in the direction of alignment of the nozzles, it is possible to respond to a case where the positional deviation corresponding to a maximum of four pixels to the positive or negative side is generated.

As described above, in the printer 1 according to an embodiment of the invention, by performing an ejection control operation by using the record heads 6*b* to 6*d* based on the timing correction pattern XP and the meandering correction pattern YP that are formed in the margin 2*b* of the recording sheet 2, the deviation of ink landing positions in the image forming area of the recording sheet 2 can be suppressed even in a case where a transport error of the recording sheet 2 is generated among the ejection stages. Accordingly, it is possible to prevent deterioration of the image quality of a recorded image by suppressing a color change and roughness of an image that are caused by the deviation of the landing positions.

The invention is not limited to the above-described embodiment, and various changes in forms can be made therein based on claims. In other words, in a case where a printing process is performed not by transporting the recording sheet 2 in the transport direction but by moving the record heads 6*a* to 6*d* in the print direction, the recording sheet may be deviated in the print direction. However, by applying the invention to such a case, the deviation of ink landing positions in the recording sheet can be prevented in an effective manner.

In addition, for example, in the above-described embodiment, a configuration in which an image recording operation or the like is performed by sequentially transferring the recording sheet 2 among a plurality of ejection stages 3 and transport mechanisms 5 disposed in each ejection stage has been described as an example. However, the invention is not limited thereto. Thus, for example, a configuration in which only one transport mechanism that drives a long endless belt along a transport path is included, and an image or the like is sequentially recorded by using each record head 6 while the recoding sheet 2 is transported by the one transport mechanism can be employed. When a long endless belt is used, a transport error for the recording sheet 2 may be generated due to loosening of the belt or the like. However, by applying the invention, the deviation of ink landing positions in the recording sheet can be prevented in an effective manner even in a case where the transport error is generated.

In addition, in the above-described embodiment, the record head 6 having a configuration in which a liquid is ejected by generating a pressure change for the liquid by displacing the thin-walled part 22 using the electrostatic force has been described as an example. However, the invention is not limited thereto, and a liquid ejecting head using a piezoelectric vibrator, a heating element, or the like as a driving source may be used.

Furthermore, the invention may be applied to a liquid ejecting device other than the above-described printer as long as the liquid ejecting device uses a configuration in which a liquid lands in a landing target while the landing target is transported. For example, the invention can be applied to a display manufacturing apparatus, an electrode manufacturing apparatus, a chip manufacturing apparatus, or the like.

The entire disclosure of Japanese Patent Application No: 2007-288159, filed Nov. 6, 2008 is expressly incorporated by reference herein.

What is claimed is:

1. A liquid ejecting device comprising:

a nozzle group formed by aligning a plurality of nozzles that eject a liquid; and a liquid ejecting head that ejects liquids from the plurality of nozzles based on ejection serial data that is information representing ejection or non-ejection of each nozzle of the nozzle group, wherein the liquid ejecting head ejects a liquid to a landing target while the liquid ejecting head and the landing target are relatively moved in a second direction that is perpendicular to a first direction in which the plurality of nozzles is aligned, and wherein the nozzle group includes a preliminary nozzle corresponding to an area outside a regulated landing area of the landing target, the liquid ejecting device further comprising:

a meandering correction pattern forming unit that forms a meandering correction pattern along the second direction in a margin outside the regulated landing area of the landing target;

a meandering correction pattern detecting unit that detects the meandering correction pattern formed in the landing target by the meandering correction pattern forming unit; and a data correction unit that corrects the ejection serial data in accordance with a deviation of the meandering correction pattern detected by the meandering pattern detecting unit, wherein the data correction unit adds dummy data, which represents non-ejection, corresponding to the amount of the deviation to the front of the ejection serial data in a case where the meandering correction pattern detected by the meandering correction pattern detecting unit is deviated from the original position to one side of the first direction and removes data, which is located on the front side of the ejection serial data, corresponding to the amount of the deviation in a case where the detected meandering correction pattern is deviated from the original position to the other side of the first direction.

2. The liquid ejecting device according to claim 1, wherein a plurality of ejection stages is disposed along the second direction, wherein the liquid ejecting head is disposed in each of the plurality of ejection stages, wherein the meandering correction pattern forming unit forms the meandering correction pattern in the landing target in a first ejection stage that is located in the front side of the second direction by using the liquid ejecting head disposed in the first ejection stage, wherein the meandering correction pattern detecting unit is disposed in each of the plurality of ejection stages that is located after the first ejection stage, and wherein the data correction unit corrects the ejection serial data for each of the plurality of ejection stages that is located after the first ejection stage.

3. The liquid ejecting device according to claim 2, further comprising:

an encoder pulse outputting unit that outputs an encoder pulse in accordance with driving a movement unit that moves the landing target or the liquid ejecting head in the second direction in the first ejection stage;

a timing correction pattern forming unit that forms a timing correction pattern in the margin of the landing target along the second direction in the first ejection stage;

a timing correction pattern detecting unit that is disposed in each of the plurality of ejection stages that is located after the first ejection stage and detects the timing correction pattern formed in the landing target by the timing correction pattern forming unit; and a timing pulse generating unit that generates a timing pulse based on a detection pulse that is output in accordance with the encoder pulse output from the encoder pulse outputting unit or detection of the timing correction pattern by the timing correction pattern detecting unit, wherein the timing pulse generating unit generates the timing pulse based on the encoder pulse in the first ejection stage and generates the timing pulse based on the detection pulse in the plurality of ejection stages that are located after the first ejection stage, and wherein the liquid ejecting head ejects a liquid at a timing regulated in accordance with the timing pulse.

4. A method of controlling a liquid ejecting device including:

a nozzle group formed by aligning a plurality of nozzles that eject a liquid; and a liquid ejecting head that ejects liquids from the plurality of nozzles based on ejection serial data that is information representing ejection or non-ejection of each nozzle of the nozzle group, wherein the liquid ejecting device ejects a liquid from the liquid ejecting head to a landing target while the liquid ejecting head and the landing target are relatively moved in a second direction that is perpendicular to a first direction in which the plurality of nozzles is aligned, the method comprising:

disposing a preliminary nozzle corresponding to an area outside a regulated landing area of the landing target in the nozzle group;

forming a meandering correction pattern along the second direction in a margin outside the regulated landing area of the landing target;

detecting the meandering correction pattern formed in the landing target; and adding dummy data, which represents non-ejection, corresponding to the amount of the deviation to the front side of the ejection serial data in a case where the detected meandering correction pattern is deviated from the original position to one side of the first direction and removing data, which is located on the front side of the ejection serial data, corresponding to the amount of the deviation in a case where the detected meandering correction pattern is deviated from the original position to the other side of the first direction.

5. The method according to claim 4, further comprising:

forming the meandering correction pattern in the landing target in a first ejection stage that is located in the front side of the second direction by using the liquid ejecting head disposed in a first ejection stage;

detecting the meandering correction pattern in each of plurality of ejection stages located after the first ejection stage; and correcting the ejection serial data based on the meandering correction pattern, wherein the plurality of ejection stages is disposed along the second direction.

6. The method according to claim 5, further comprising:

forming a timing correction pattern in the margin of the landing target along the second direction in the first ejection stage;

detecting the timing correction pattern formed in the landing target in each of the plurality of ejection stages that is located after the first ejection stage;

generating the timing pulse based on an encoder pulse that is output in synchronization with driving a movement unit, which moves the landing target or the liquid ejecting head in the second direction in the first ejection stage, in the first ejection stage and generating the timing pulse based on a detection pulse that is output in accordance with detection of the timing correction pattern in the plurality of ejection stages that are located after the first ejection stage; and controlling liquid ejection of the liquid ejecting head at a timing regulated in accordance with the timing pulse.

* * * * *